US006149487A

United States Patent [19]

Peng

[11] Patent Number: 6,149,487

[45] Date of Patent: Nov. 21, 2000

[54] MULTI-PURPOSE INTERLOCKING BLOCK

[76] Inventor: Jung-Chieh Peng, P.O. Box 82-144, Taipei, Taiwan

[21] Appl. No.: 09/172,633

[22] Filed: Oct. 14, 1998

[51] Int. Cl.[7] ..... A63H 33/08

[52] U.S. Cl. ..... 446/114; 446/108; 446/256

[58] Field of Search ..... 446/108, 114, 446/219, 256; 273/DIG. 24

[56] References Cited

U.S. PATENT DOCUMENTS

| | | | |
|---|---|---|---|
| 2,633,662 | 4/1953 | Nelson | 446/114 |
| 2,984,935 | 5/1961 | Beck | 446/114 |
| 3,564,758 | 2/1971 | Willis | 446/114 |
| 3,698,124 | 10/1972 | Reitzel et al. | 446/114 |
| 3,940,100 | 2/1976 | Haug | 446/114 |
| 4,789,370 | 12/1988 | Ellefson | 446/114 |
| 5,163,862 | 11/1992 | Philips et al. | 446/114 |
| 5,628,666 | 5/1997 | Tomczyk et al. | 446/114 |
| 5,672,087 | 9/1997 | De La Paz Rizo et al. | 446/108 |
| 5,833,512 | 10/1998 | Nicola | 446/114 |

FOREIGN PATENT DOCUMENTS

| | | | |
|---|---|---|---|
| 2054393 | 2/1981 | United Kingdom | 446/108 |

OTHER PUBLICATIONS

Playplax Squares—advertisement, Mar. 1968.

*Primary Examiner*—Jacob K. Ackun
*Assistant Examiner*—Jeffrey D. Carlson
*Attorney, Agent, or Firm*—A & J

[57] ABSTRACT

A multi-purpose interlocking pentagonal block having five points each formed with a slot, the slot having a width slightly greater than a thickness of the block, two adjacent edges of the block having a notch therebetween, the notch having a width greater than the width of the slot, whereby the multi-purpose interlocking block can be assembled with other similar blocks into many different structures and can be used as a dart or top to play with.

1 Claim, 4 Drawing Sheets

MULTI-PURPOSE INTERLOCKING BLOCK

BACKGROUND OF THE INVENTION

1. Field of the Invention

This invention is related to a multi-purpose interlocking block.

2. Description of the Prior Art

A variety of construction toys have been disclosed, and have appeared on the market. These construction toys commonly comprise a plurality of block elements having pins and pin holes for connection with one another in limited directions. However, such block toys cannot provide other games than building certain shapes and so conventional block toys provide less variation.

Therefore, it is an object of the present invention to provide a multi-purpose interlocking block which can obviate and mitigate the above-mentioned drawbacks.

SUMMARY OF THE INVENTION

This invention is related to a multi-purpose interlocking block.

It is the primary object of the present invention to provide a multi-purpose interlocking block which can be assembled with other similar blocks into many different structures.

It is another object of the present invention to provide a multi-purpose interlocking block which can be used as a dart to play with.

It is still another object of the present invention to provide a multi-purpose interlocking block which is interesting and funny to play.

It is still another object of the present invention to provide a multi-purpose interlocking block which can be used as a top to play with.

It is a further object of the present invention to provide a multi-purpose interlocking block which is simple in construction and low in cost.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 2:
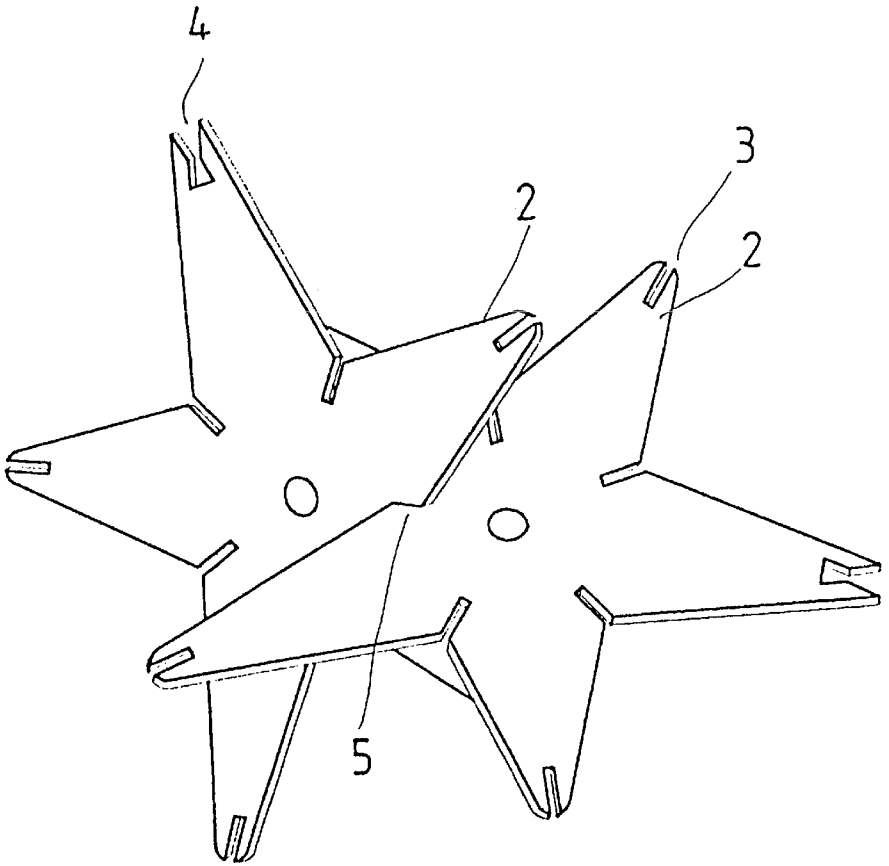
FIG. 2 is a perspective view showing two interlocking blocks.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 1:
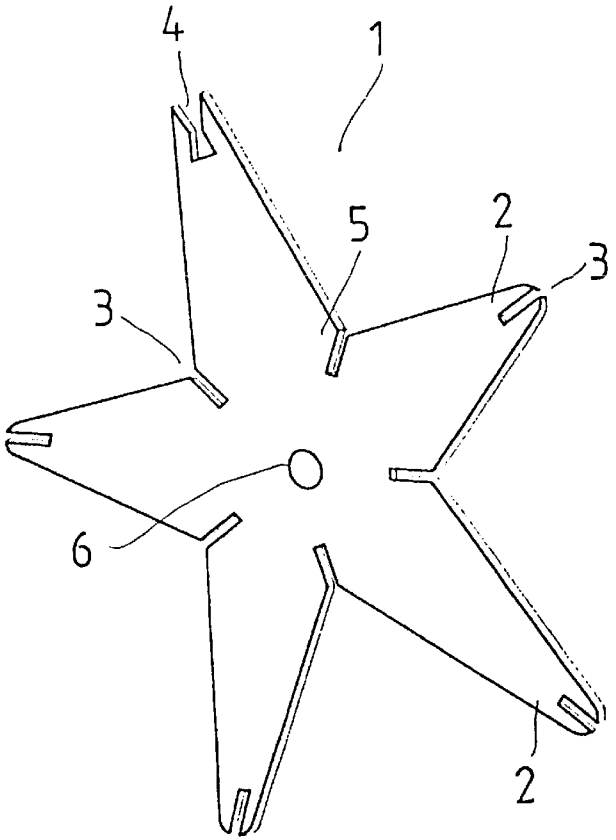
FIG. 1 is a perspective view of the present invention.

With reference to the drawings and in particular to FIGS. 1 and 2 thereof, the multi-purpose interlocking block 1 according to the present invention is shaped as a pentagram having five points 2. Four of the five points 2 is formed with a slot 3 having a width slightly greater than the thickness of the block 1, while one of the five points has a notch 4 which is greater than the slot 3. Between every two adjacent edges there is a slot 3. One side of the block 1 is provided with a protuberance 6 at the center.

Figure 3:
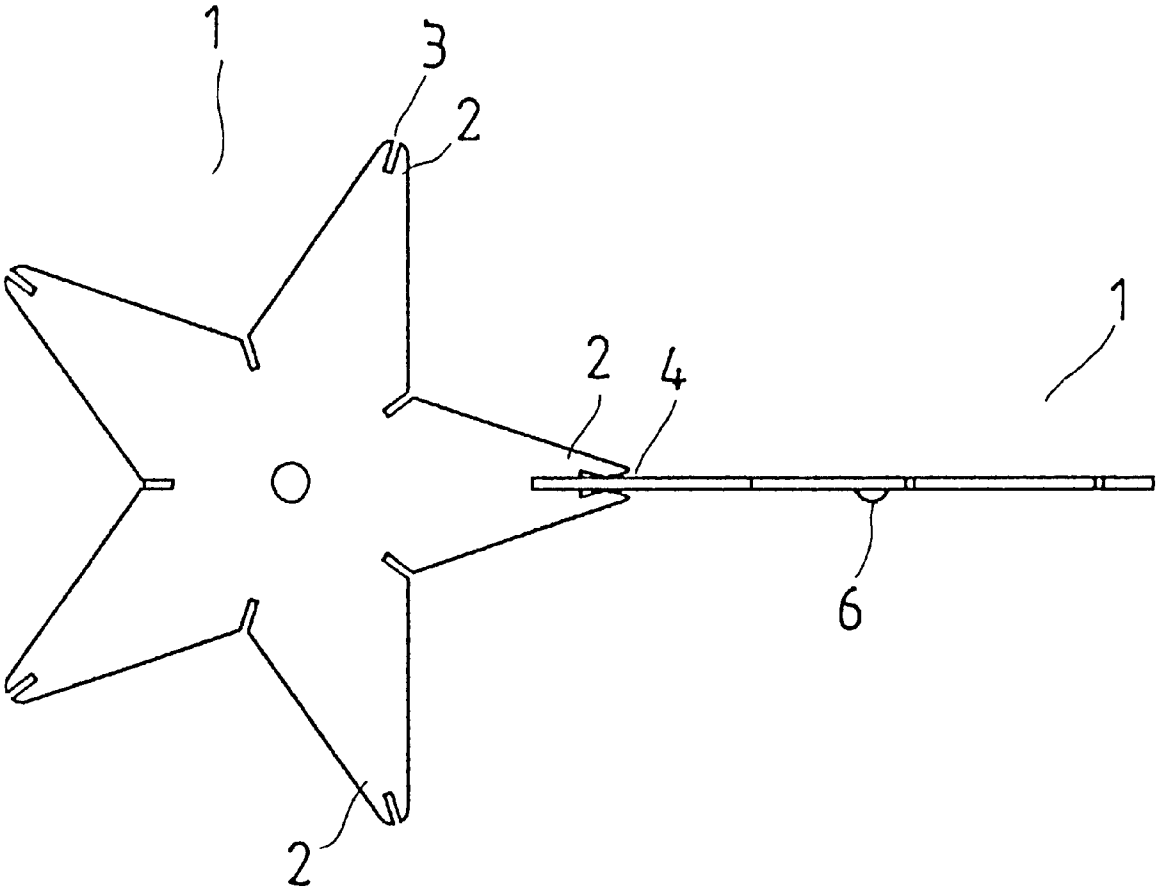
FIG. 3 illustrates how to use the present invention as a dart.

FIG. 3 illustrates how to use the present invention as a dart. As shown, the notches 4 of two blocks 1 are first interlocked together, and one of the blocks 1 is pulled backward and then released, thereby throwing out the block 1 as a dart. In addition, as the block 1 is provided with a protuberance 6 at the center, it can be freely spinned as a top. Furthermore, the block 1 may be coated with a fluoresent material so that it can be seen even in the dark thus making it more interesting.

Figure 4:
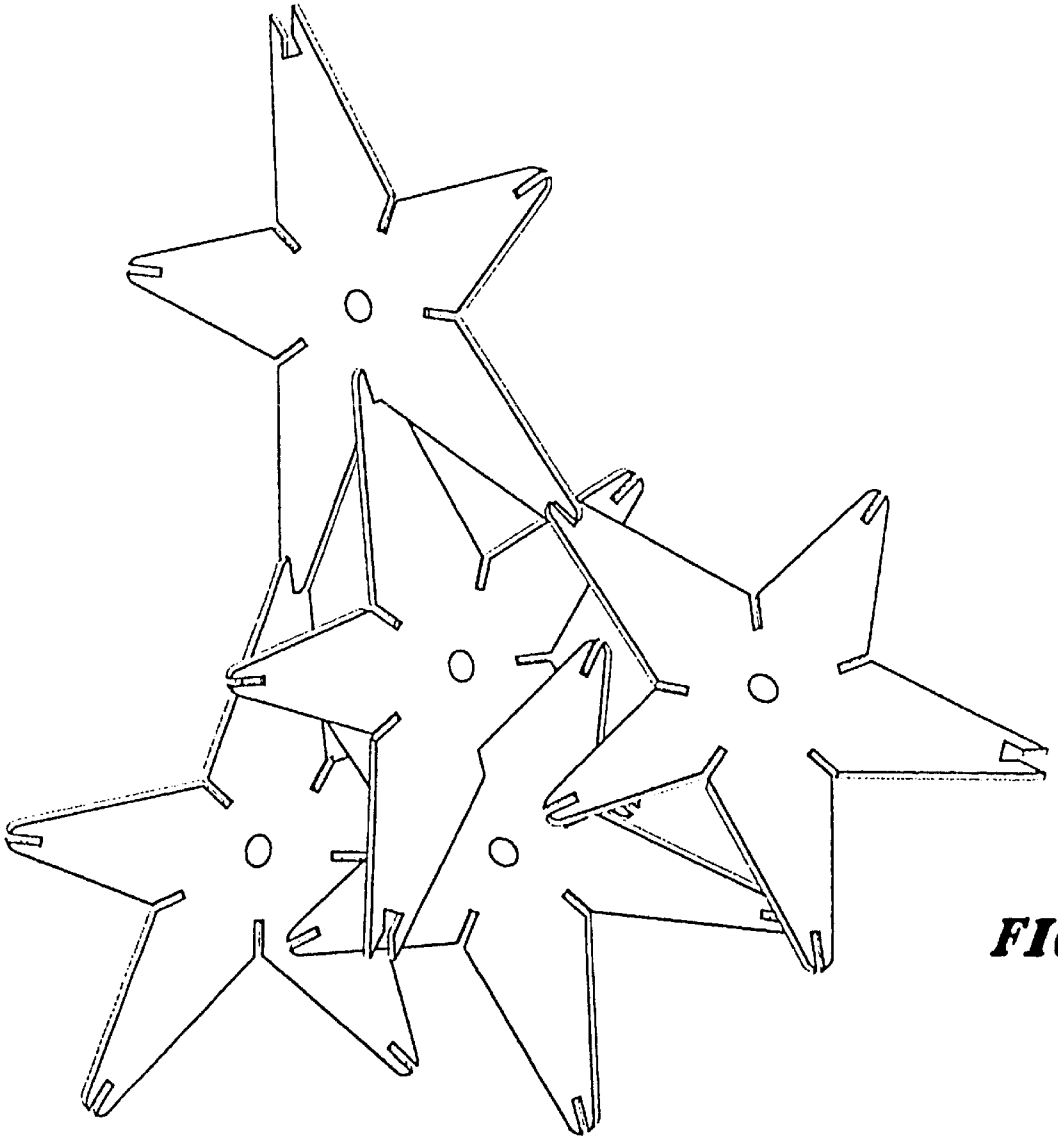
FIG. 4 illustrates how to build a desired structure with the blocks.
Figure 5:
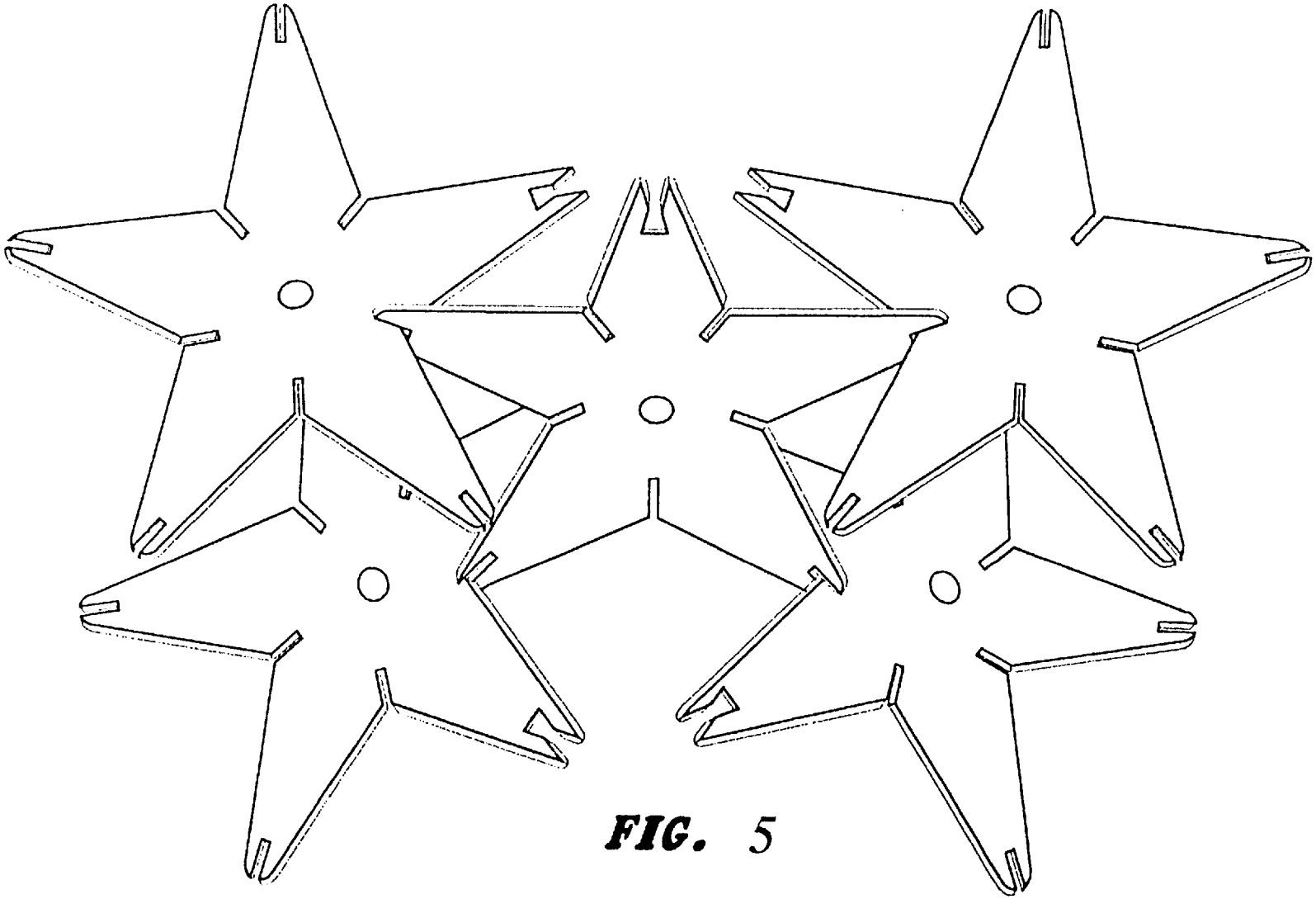
FIG. 5 illustrates how to build another desired structure with the blocks.

FIGS. 4 and 5 illustrate how to build different structures by interlocking a plurality of the blocks. As illustrated, the slot 3 at the point 2 of a block 1 can be engaged with the slot 3 at the point 2 of another block 1 or the slot 3 at the position between two adjacent edges of another block 1, or the slot 3 at the position between two adjacent edges of a block 1 can be assembled with the slot 3 at the position between two adjacent edges of another block 1 into different structures.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A multi-purpose interlocking star shaped block having five points each formed with a slot, each of said slots having a width slightly greater than a thickness of said block, five notches each formed between two adjacent edges between two adjacent points of said block, each of said notches having a width greater than said width of said slot, one side of said block being provided with a protuberance at a center of said side, said block being coated with fluorescent material.

* * * * *